US005547632A

United States Patent [19]

Horimura et al.

[11] Patent Number: 5,547,632

[45] Date of Patent: Aug. 20, 1996

[54] POWDER FORGING PROCESS

[75] Inventors: Hiroyuki Horimura; Kenji Okamoto; Masahiko Minemi, all of Saitama; Toshihiko Kaji, Hyogo; Yoshinobu Takeda, Hyogo; Yoshishige Takano, Hyogo, all of Japan

[73] Assignees: Sumitomo Electric Industries, Ltd., Osaka; Honda Giken Kogyo Kabushiki Kaisha, Tokyo, both of Japan

[21] Appl. No.: 359,674

[22] Filed: Dec. 20, 1994

[30] Foreign Application Priority Data

Dec. 24, 1993 [JP] Japan ..... 5-328463

[51] Int. Cl.[6] ..... B22F 3/16

[52] U.S. Cl. ..... 419/28; 419/38; 419/48

[58] Field of Search ..... 419/28, 38, 48

[56] References Cited

U.S. PATENT DOCUMENTS

| | | | |
|---|---|---|---|
| 3,177,573 | 4/1965 | Foerster | 29/420 |
| 4,135,922 | 1/1979 | Cebulak | 75/143 |
| 4,838,936 | 6/1989 | Akechi | 75/249 |
| 4,915,605 | 4/1990 | Chan et al. | 419/6 |
| 5,009,842 | 4/1991 | Hendrickson et al. | 419/28 |
| 5,071,474 | 12/1991 | Raybould et al. | 75/249 |

FOREIGN PATENT DOCUMENTS 58-122142 8/1983 Japan .

OTHER PUBLICATIONS

*Metals Handbook Desk Edition*, American Society for Metals, Ohio, 1985, pp. 24.1–24.31.

*Primary Examiner*—Donald P. Walsh
*Assistant Examiner*—Daniel J. Jenkins
*Attorney, Agent, or Firm*—Lyon & Lyon

[57] ABSTRACT

In a powder forging process, a heated green compact is placed in a stationary die and subjected to a press-forging carried out mainly to reduce the thickness thereof by cooperation of the stationary die with a movable die. The press-forging is performed at two pressing steps. After placement of the green compact into the concave molding portion of the stationary die, the pressing step were carried out. Thus, it is possible to produce a forged product having a high strength and a high toughness. A heated heat insulator also may be placed in the stationary die to provide a temperature-retaining effect to the green compact before and during pressing.

22 Claims, 5 Drawing Sheets

POWDER FORGING PROCESS

BACKGROUND OF THE INVENTION

The present invention relates to a powder forging process, and particularly, to a powder forging process in which a heated green compact is placed into a stationary die and a press-forging is carried out for mainly reducing the thickness of the green compact by cooperation of the stationary die with a movable die.

DESCRIPTION OF THE PRIOR ART

In a powder forging process of this type, a press-forging consisting of a single-stage pressing step has been commonly employed. As used in the present specification, the term "single stage pressing step" means a step where the movable die is moved in one reciprocation.

In carrying out the powder forging process, operations are required such as removing of the green compact from a heating device and placing of the green compact into the stationary die within a period before the start of the press-forging after heating of the green compact, and for this reason, the temperature of the green compact drops.

To prevent such a drop in the temperature, a process including a formation of a temperature-retaining coating layer on a surface of a forging blank has been conventionally employed (for example, see Japanese Patent Application Laid-open No. 122142/83).

With the prior art press-forging process, however, there are problems as follows:

Particularly when the green compact is formed from a fine aluminum alloy powder having excellent properties, it is impossible to sufficiently destroy oxide films on surfaces of particles of the powder to produce bonding of newly produced surfaces over the entire green compact. Consequently, it is difficult to produce a forged product having a high strength and a high toughness.

On the other hand, in the prior art temperature-retained process, there has been employed a technique in which a liquid material is applied on the surface of the blank for forming the coating layer. If this technique is utilized for a green compact formed of an aluminum alloy powder, the following problem is encountered: the bonding of the particles of the aluminum alloy powder does not occur in the heating step, because of the presence of the oxide films on the surfaces of the aluminum alloy particles. As a result, the liquid material is penetrated into pores in the green compact at the heating step, and the penetrated material remains as foreign matter in the forged product, resulting in a degraded bondability of the particles of the aluminum alloy powder to hinder the densification, thereby failing to produce a forged product having a high strength and a high toughness.

SUMMARY OF THE INVENTION

Accordingly, it is an object of the present invention to provide a powder forging process of the type described above, which is capable of producing a forged product having a high strength and a high toughness by performing the press-forging at a plurality of stages.

To achieve the above object, according to the present invention, there is provided a powder forging process in which a heated green compact is placed into a stationary die and a press-forging is carried out for mainly reducing the thickness of the green compact, by cooperation of the stationary die with a movable die, wherein the press-forging comprises pressing steps which are carried out after placement of the green compact into the stationary die.

When the press-forging is divided into a plurality of steps, it is possible to control the speed of movement of the movable die up to reaching a forging pressure, so that the bonding of powder particles advances preferentially prior to the densification of the green compact, for example, at a first pressing step, and the densification of the green compact and the bondability of the powder particles is enhanced at a second pressing step.

Each pressing step is carried out with the green compact remaining placed within the stationary die without being removed. Therefore, it is possible to suppress the dropping of the temperature of the green compact to the utmost to avoid the degradation of the moldability.

This makes it possible to produce a forged product having a high strength and a high toughness.

In a powder forging process using a green compact formed of an aluminum alloy powder, it is conventionally required for the aluminum alloy powder that particles of the powder have a large particle size, irregular shapes, and a small deformation resistance at a high temperature, from the viewpoint of the destruction of oxide films during the forging. For this reason, if a reduction in particle size or the like is attempted to enhance the properties of the aluminum alloy powder, it is difficult in the prior art process to mold the powder, resulting in a forged product having poor properties.

If a press-forging comprising a plurality of pressing steps as described above is utilized, it is possible to mold the aluminum alloy powder, when the particles of the aluminum alloy powder have an average particle size of at most 40 μm, and even when the aluminum alloy powder contains a total amount of 4% by atom of any elements selected from the group consisting of Fe, Ni, Co, Mn, Cr, Ti, Zr and the like which are heat-resistant elements. It is also possible to sufficiently destruct oxide films on surfaces of the particles to produce the bonding of newly produced surfaces over the entire green compact.

It is possible to produce an extrudate by employing a billet of such an aluminum alloy powder and subjecting it to a hot extrusion, but the above-described press-forging enables the yield of the aluminum alloy powder and the total cost, such as the operating cost, to be reduced to one third or one half of those in the hot extrusion.

It is another object of the present invention to provide a powder forging process of the type described above, which is capable of producing a forged product having a high strength and a high toughness by providing a temperature-retaining effect to the green compact of the aluminum alloy powder by a heat insulator separate from the green compact.

To achieve the above object, according to the present invention, there is provided a powder forging process in which a heated green compact is placed into a stationary die and a press-forging is carried out by cooperation of the stationary die with a movable die, wherein the green compact is formed from aluminum alloy powder and a heat insulator providing a temperature-retaining effect to the green compact and non-fusible to the green compact in the forging course is placed into the stationary die along with the green compact.

If the heat insulator is employed in the above manner, it is possible to maintain the green compact at a predetermined temperature immediately before the start of the forging and hence, it is not necessary to excessively heat the green compact on the assumption that the temperature will be dropping up to the start of the forging. Thus, it is possible to refine the metallographic structure in the forged product to achieve an increase in strength of the forged product. An increase in deformation resistance of the green compact can be suppressed by such temperature-retaining effect and therefore, it is possible to enhance the bondability of the particles of the aluminum alloy powder to achieve an increased toughness of the forged product.

This is also achieved, when the aluminum alloy powder is refined as described above and when the aluminum alloy powder contains any of the above-described heat-resistant elements.

In the powder forging process including the press-forging mainly carried out to reduce the thickness of the green compact as described above, the stationary die which may be used has a concave molding portion, while the movable die which may be used has a convex molding portion. In this case, the surface of the green compact opposed to the stationary die is only brought into static contact with a bottom surface of the concave molding portion, while the surface of the green compact opposed to the movable die is only brought into static contact with an end face of the convex molding portion, both without sliding friction being produced therebetween. As a result, a rapid drop of temperature is produced in opposite opposed surfaces of the green compact and hence, surface defects are liable to be produced on opposite opposed surfaces of the forged product due to poor bonding of the particles. Such a problem can be overcome by disposing two heat insulators on opposite opposed surfaces of the green compact, i.e., by placing the green compact into the concave molding portion in a such a manner that it is sandwiched between the two heat insulators.

The forged product produced by this process can be put into use without machining of the opposite opposed surfaces, thereby bringing about a reduction in working cost and an increase in yield.

The heat insulator is non-fusible to the green compact and hence, can be reused.

The above and other objects, features and advantages of the invention will become apparent from the following description of preferred embodiments taken in conjunction with the accompanying drawings.

DESCRIPTION OF THE PREFERRED EMBODIMENTS

A. Powder forging process including press-forging carried out at pressing step consisting of a plurality of stages.

Embodiment I

Figure 1:
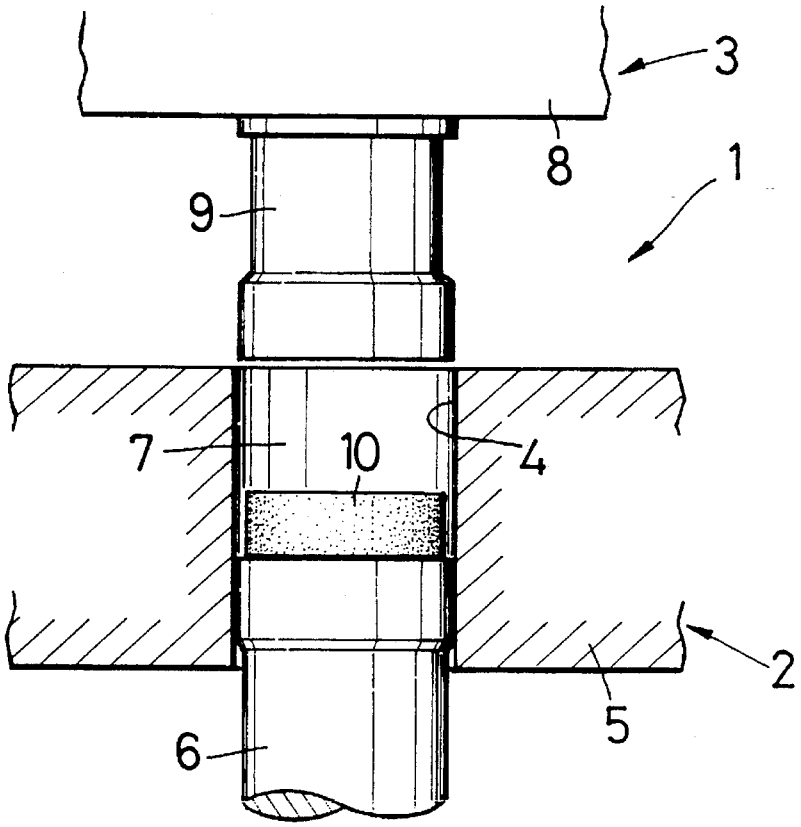
FIG. 1 is a vertical sectional view illustrating one example of a powder forging process.

Referring to FIG. 1, a powder forging machine is comprised of a stationary die 2 and a movable die 3 disposed above the stationary die 2. The stationary die 2 includes a die body 5 having a circular bore 4 opened into upper and lower opposite surfaces, and a movable rod 6 slidably fitted into the circular bore 4 from below. A concave molding portion 7 is defined by an upper end face of the movable rod 6 and substantially half of the circular bore 4 located above such upper end face. The movable die 3 is comprised of a holder 8 and a convex molding portion 9 projecting from a lower surface of the holder 8 and slidably fitted into the concave molding portion 7.

A molten metal having a composition of $Al_{93}Fe_{4.5}Zr_{0.5}Si_2$ (each of the numerical values is % by atom) was prepared. This molten metal was used to produce an aluminum alloy powder by utilizing a nitrogen gas atomizing process. The aluminum alloy powder was subjected to a classifying treatment to provide aluminum alloy powder particles having a particle size of 105 μm or less. These aluminum alloy powder particles have an average particle size of 38 μm. The observation of the aluminum alloy powder particles by SEM (a scanning type electronic microscope) showed that they were spherical.

Figure 2:
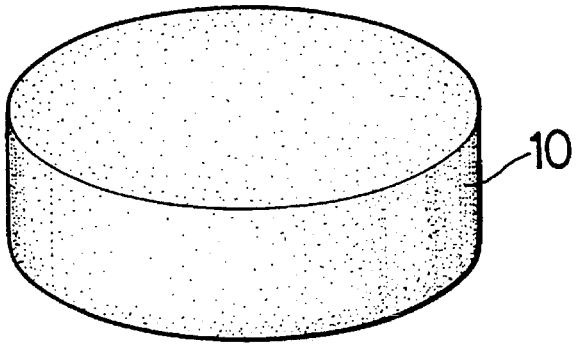
FIG. 2 is a perspective view of one example of a green compact.

The aluminum alloy powder in an amount of 300 grams was used and subjected to a monoaxial compaction under a compacting pressure of 6 tons/cm$^2$ to produce a disk-like green compact 10 having a diameter of 76 mm and a thickness of 29 mm, as shown in FIG. 2. The relative density of the green compact 10 was about 76%.

The green compact 10 was heated to 570° C. in about 5 minutes by utilizing a high-frequency heating and was then maintained at such temperature for 5 seconds. Thereafter, the green compact was placed into the concave molding portion 7 having an inside diameter 78 mm with the stationary die 2 heated to 200° C. The temperature of the movable die 3 also was 200° C.

The green compact 10 was subjected to a press-forging by cooperation of the convex molding portion 9 and the concave molding portion 7 under conditions of a forging pressure set at 8 tons/cm$^2$ and varied speeds of movement of the movable die 3 up to reaching such forging pressure. The press-forging was carried out at both a single-stage pressing step and a plurality of pressing steps, e.g., two steps in the embodiment.

Each of forged products produced in this manner had a diameter of 78 mm and a thickness of 27.5 mm, and the relative density thereof was 99% or more.

Test pieces were fabricated from each of the forged products and subjected to a tensile test and a Charpy impact test to provide results given in Table 1.

TABLE 1

| Test piece | Speed of movement of movable die (mm/sec) First press stage | Second press stage | Tensile strength (kgf/mm²) | Charpy impact value (J/cm²) |
|---|---|---|---|---|
| (1) | 40 | — | 49.2 | 1.7 |
| (2) | 60 | — | 39.8 | 3.1 |
| (3) | 60 | 40 | 59.4 | 22.2 |
| (4) | 40 | 40 | 56.8 | 9.8 |
| (5) | 40 | 60 | 53.3 | 10.2 |

In Table 1, the term "speed of movement of movable die 3" means a speed of movement at a load of zero, i.e., a speed of movement of the movable die 3 up to contacting the convex molding portion 9 with the green compact 10, and is not a speed of movement of the movable die during the press-forging after contacting the convex molding die 9 with the green compact 10. The higher the speed of movement of the movable die 3 at the load of zero, the higher the speed of movement of the movable die 3 up to reaching the forging pressure.

As apparent from Table 1, if a pressing step consisting of two stages is employed in the press-forging, as for the test pieces (3) to (5), a forged product having a high strength and a high toughness can be produced, as compared with the employment of a single-stage pressing step in the press-forging, as for the test pieces (1) and (2).

When the two-stage pressing step was employed, the test piece (3) had the best mechanical properties. It can be seen that to produce such an excellent forged product, the speed V2 of movement of the movable die 3 up to reaching a forging pressure in the second stage of the pressing step is preferably set at a value lower than the speed $V_1$ of movement of the movable die 3 up to reaching the same forging pressure in the first stage of the pressing step. This is because if the speed of movement of the movable die 3 in the first stage of the pressing step is increased, a shear force on a powder interface is increased. Therefore, the destruction of oxide films is efficiently performed, thereby causing the bonding of particles of the aluminum alloy powder to advance preferentially prior to the densification. If the speed of movement of the movable die 3 at the second stage of the pressing step is lower than that at the first stage of the pressing step, the densification advances, and beginning with bonded surfaces produced at the first stage of the pressing step, the bonding of newly produced surfaces advances in a wider range, thereby allowing the bonding of the particles to be produced over the entire green compact 10.

For comparison, a green compact 10 similar to that described above was heated to 570° C. in about 5 minutes by utilizing a high-frequency heating and then maintained at such temperature for 5 seconds. Thereafter, the green compact 10 was placed into the concave molding portion 7 having an inside diameter of 78 mm in the stationary die 2 heated to 200° C.

The green compact 10 was subjected to a press-forging by cooperation of the convex molding portion 9 and the concave molding portion 7 under conditions of a forging pressure set at 8 tons/cm² and a speed of movement of the movable die 3 (also heated to 200° C.) which was set at a predetermined value, thereby providing an intermediate product. The intermediate product after being released from the die had a temperature of 300° C.

The intermediate product was reheated to 570° C. in about 3 minutes by utilizing a high-frequency heating and then maintained at such temperature for 5 seconds. Thereafter, the intermediate product was placed into the concave molding portion 7 having an inside diameter of 80 mm in the stationary die 2 heated to 200° C.

The intermediate product was subjected to a press-forging by cooperation of the convex molding portion 9 and the concave molding portion 7 under conditions of a forging pressure set at 8 tons/cm² and a speed of movement of the movable die 3 (heated to 200° C.) which is set at a predetermined value, thereby producing a forged product.

Test pieces were fabricated from each of the forged products and subjected to a tensile test and a Charpy impact test to provide results given in Table 2.

TABLE 2

| Test piece | Speed of movement of movable die (mm/sec) First press stage | Second press stage | Tensile strength (kgf/mm²) | Charpy impact value (J/cm²) |
|---|---|---|---|---|
| (1a) | 60 | 40 | 46.6 | 23.0 |
| (2a) | 40 | 40 | 42.7 | 21.2 |
| (3a) | 60 | 60 | 40.5 | 20.7 |
| (4a) | 40 | 60 | 42.5 | 6.5 |

By comparison of the test pieces (3) to (5) with the test pieces (1*a*) to (4*a*) in Tables 1 and 2, it can be seen that each of the test pieces (1*a*) to (4*a*) has a lower tensile strength due to a coalescence of the metallographic structure by two runs of heating. With the test pieces (1*a*) to (3*a*), however, the Charpy impact value is relatively increased due to the fact that the speed of movement of the movable die 3 in the first run of press-forging is higher, or the speeds of movement of the movable die 3 in both the first and second runs of press-forging are equal to each other.

Embodiment II

The aluminum alloy powder in an amount of 500 grams of the same type as the aluminum alloy powder used in the first embodiment (having a composition of $Al_{93}Fe_{4.5}Zr_{0.5}Si_2$) was used to produce a green compact having a thickness of 29 mm and a shape like a connecting rod for an internal combustion engine by a monoaxial compaction under a condition of a compacting pressure of 6 tons/cm². The relative density of the green compact was about 78%.

The green compact was heated to 560° C. in about 3 minutes by utilizing a high-frequency heating and then maintained at such temperature for 5 seconds. Thereafter, the green compact was placed into a concave molding portion in the stationary die heated to 200° C. The temperature of the movable die also was 200° C.

The green compact 10 was subjected to a press-forging by cooperation of the convex molding portion and the concave molding portion with a forging pressure set at 8 tons/cm² and with a speed of movement of the movable die set at 60 mm/sec in the first stage of the pressing step and at 40 mm/sec in the second stage of the pressing step, thereby producing a connecting rod. Therefore, the speed $V_1$ of movement of the movable die up to reaching the forging pressure in the first stage of the pressing step was larger than the speed $V_2$ of movement of the movable die up to reaching the forging pressure in the second stage of the pressing step ($V_1>V_2$).

For comparison, a connecting rod was produced by a powder forging process under the same conditions, except for the use of a press-forging carried out in a single-stage pressing step.

A test piece was fabricated from a rod portion of each connecting rod and subjected to a tensile test and a Charpy impact test to provide results given in Table 3.

TABLE 3

| Test piece | Speed of movement of movable die (mm/sec) First press stage | Second press stage | Tensile strength (kgf/mm$^2$) | Charpy impact value (J/cm$^2$) |
|---|---|---|---|---|
| Example | 60 | 40 | 58.3 | 21.1 |
| Comparative example | 40 | — | 51.5 | 3.2 |

It can be seen from Table 3 that according to the example of the present invention, a connecting rod having a high strength and a high toughness as compared with the comparative example can be produced.

B. Powder Forging Process using Heat Insulation

A molten metal having a composition of $Al_{93}Fe_{4.5}Ti_{0.5}Si_2$ (each of the numerical values is % by atom) was prepared. This molten metal was used to produce an aluminum alloy powder by utilizing an air atomizing process. The aluminum alloy powder was subjected to a classifying treatment to provide aluminum alloy powder particles having a particle size of 105 μm or less.

Figure 3:
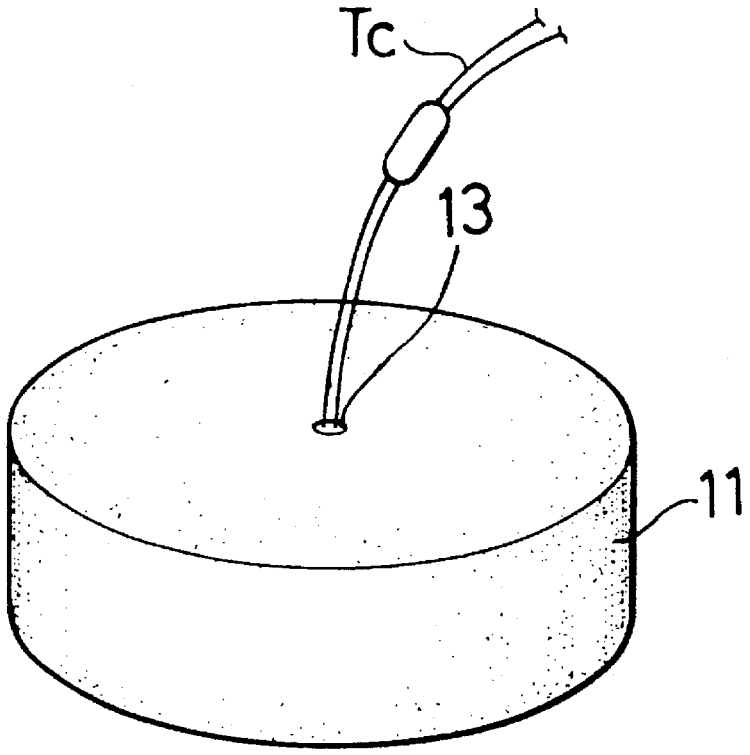
FIG. 3 is a perspective view of another example of a green compact.

The aluminum alloy powder in an amount of 300 grams was used and subjected to a monoaxial compaction under a compacting pressure of 6 tons/cm$^2$ to produce a disk-like green compact 11 having a diameter of 76 mm and a thickness of about 30 mm, as shown in FIG. 3. The relative density of the green compact 11 was about 76%.

Figure 4:
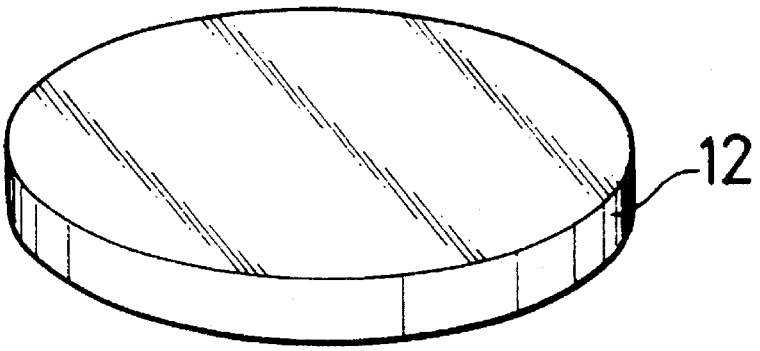
FIG. 4 is a perspective view of a heat insulator.

In addition, using a carbon steel (JIS S45C), a disk-like heat insulator 12 having a diameter of 77.5 mm and a thickness of 8 mm as shown in FIG. 4 was produced.

To examine the temperature-maintaining effect of the heat insulator 12, the following experiment was carried out using the green compact 11 and the heat insulator 12.

Figure 5:
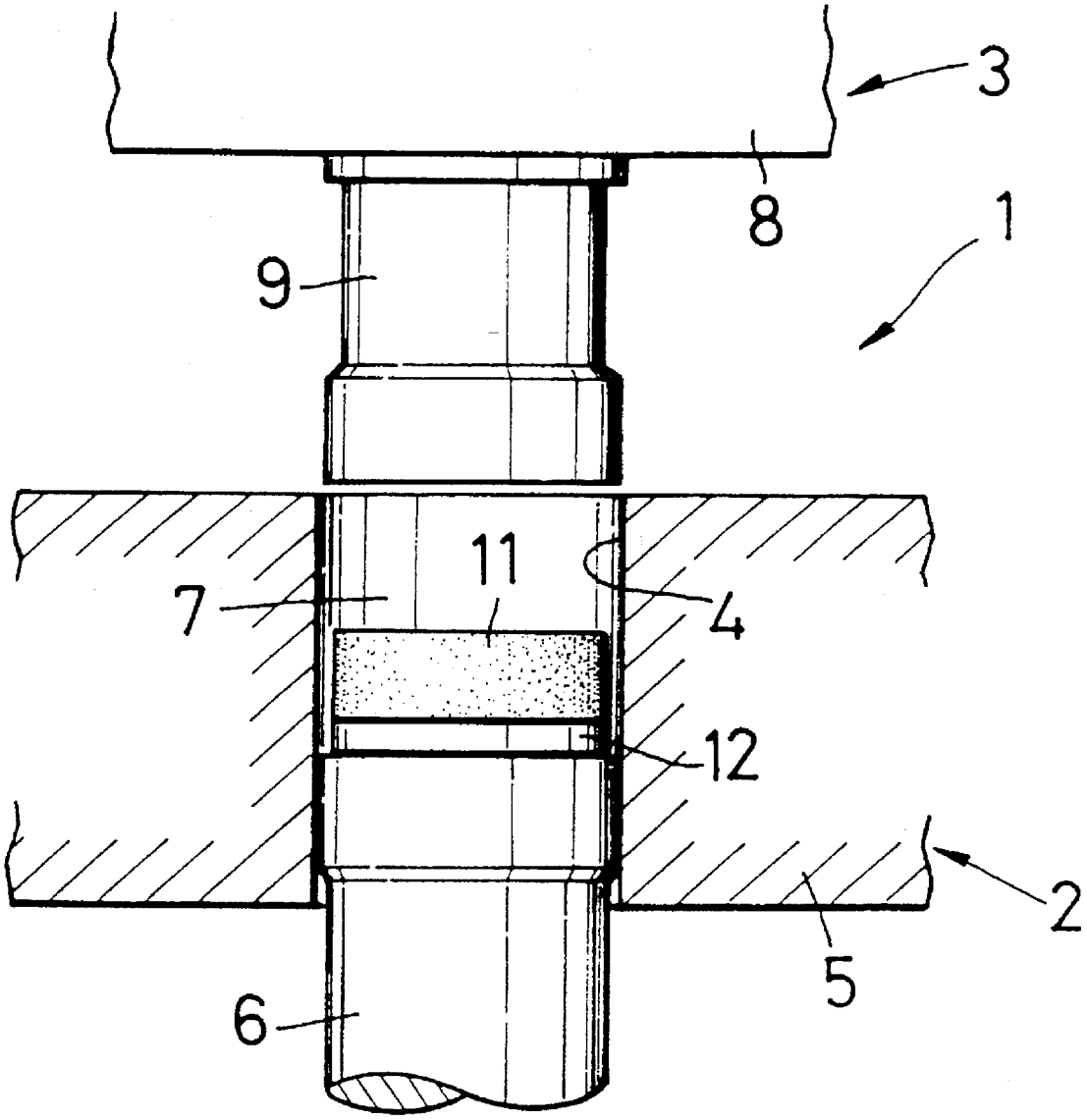
FIG. 5 is a vertical sectional view illustrating another example of a powder forging process.

As shown in FIG. 5, the stationary die 2 in the powder forging machine 1 was heated to 200° C. As shown in FIG. 3, a hole 13 was bored in a central portion of the green compact 11, and a thermo-couple Tc was inserted into the hole 13 to be able to measure the temperature of the green compact. The green compact 11 was placed into a high-frequency coil and heated to 600° C. The heat insulator 12 was also heated to 600° C. using a muffle furnace.

The green compact was removed from the high-frequency coil and immediately put onto the heat insulator 12 and placed into the concave molding portion 7 of the stationary die 2 as shown in FIG. 5. The variation in temperature of the green compact was measured. In addition, the variation in temperature of the green compact 11 was measured in a comparative test under the same conditions, except that the heat insulator 12 was not used.

Figure 6:
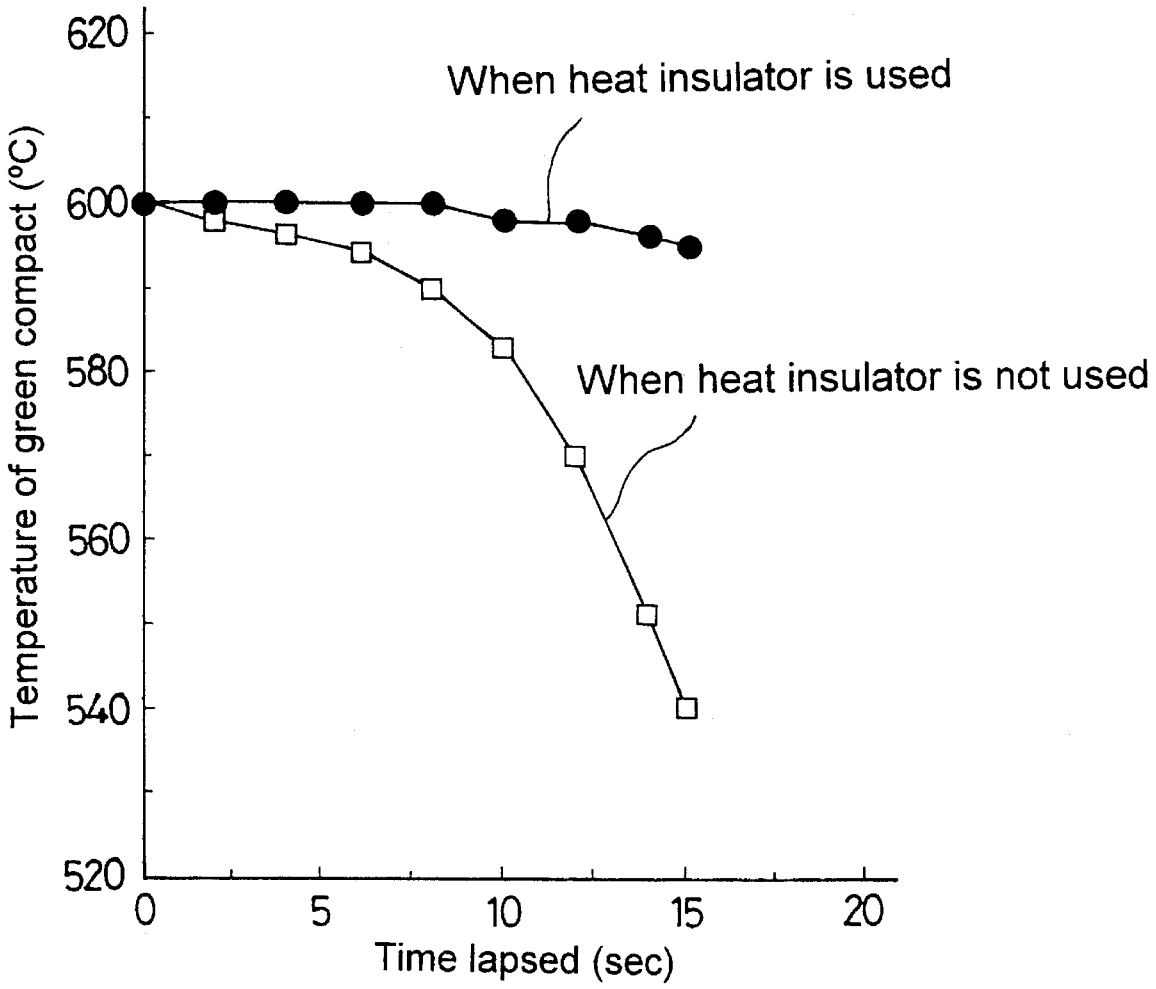
FIG. 6 is a graph illustrating the relationship between the lapsed time and the temperature of a green compact.

FIG. 6 shows the variations in temperature of the green compact. A lapsed time from the removal of the green compact from the high-frequency coil to the start of forging was about 15 seconds. As is apparent from FIG. 6, if the heat insulator 12 was used, the very little variation in temperature was generated in the green compact 11 within such lapsed time, but when the heat insulator 12 was not used, a drop in temperature by about 60° C. was generated in the green compact 11. It can be seen from this that a significant difference is produced between the case where the heat insulator 12 is used and the case where the heat insulator 12 is not used.

To provide a sufficient temperature-maintaining effect of the heat insulator 12, it is desirable to use a heat insulator 12 having a thermal conductivity $C_2$ smaller than the thermal conductivity $C_1$ of the green compact 11 ($C_2<C_1$).

A heat insulator 12 satisfying such a demand is formed of at least one metal selected from the group consisting of Fe-based alloys such as the above-described carbon steel, stainless steels and the like, Ni-based alloys such as inconel and the like, and Co-based alloys such as X40 and the like. The thermal conductivity of the above-described aluminum alloy ($Al_{93}Fe_{4.5}Ti_{0.5}Si_2$) is 80 W/m.K, but the thermal conductivity of carbon steel (JIS S45C) is 43 W/m.K; the thermal conductivity of stainless steel (JIS SUS304) is 16 W/m.K; the thermal conductivity of inconel is 15 W/m.K; and the thermal conductivity of X40 is 18 W/m.K.

Example I

A green compact ($Al_{93}Fe_{4.5}Ti_{0.5}Si_2$) 11 and a heat insulator 12 similar to those described above were used and heated to the same temperature, and the heating temperature was varied in a range of 500° to 620° C. The stationary and movable dies 2 and 3 were heated to 200° C.

The heated green compact 11 was put onto the heated heat insulator 12. They were placed into the concave molding portion 7 of the stationary die 2, as shown in FIG. 5, and subjected to a press-forging with a forging pressure set at 8 tons/cm$^2$ by cooperation of the convex molding portion 9 of the movable die 3 and the concave molding portion 7 of the stationary die 2, thereby producing various forged products. The separation of the forged product and the heat insulator was carried out by placing both of them in water after the forging (this applies in following examples).

Various forged products were also produced by the press-forging under the same conditions, except that the heat insulator 12 was not used.

Figure 7:
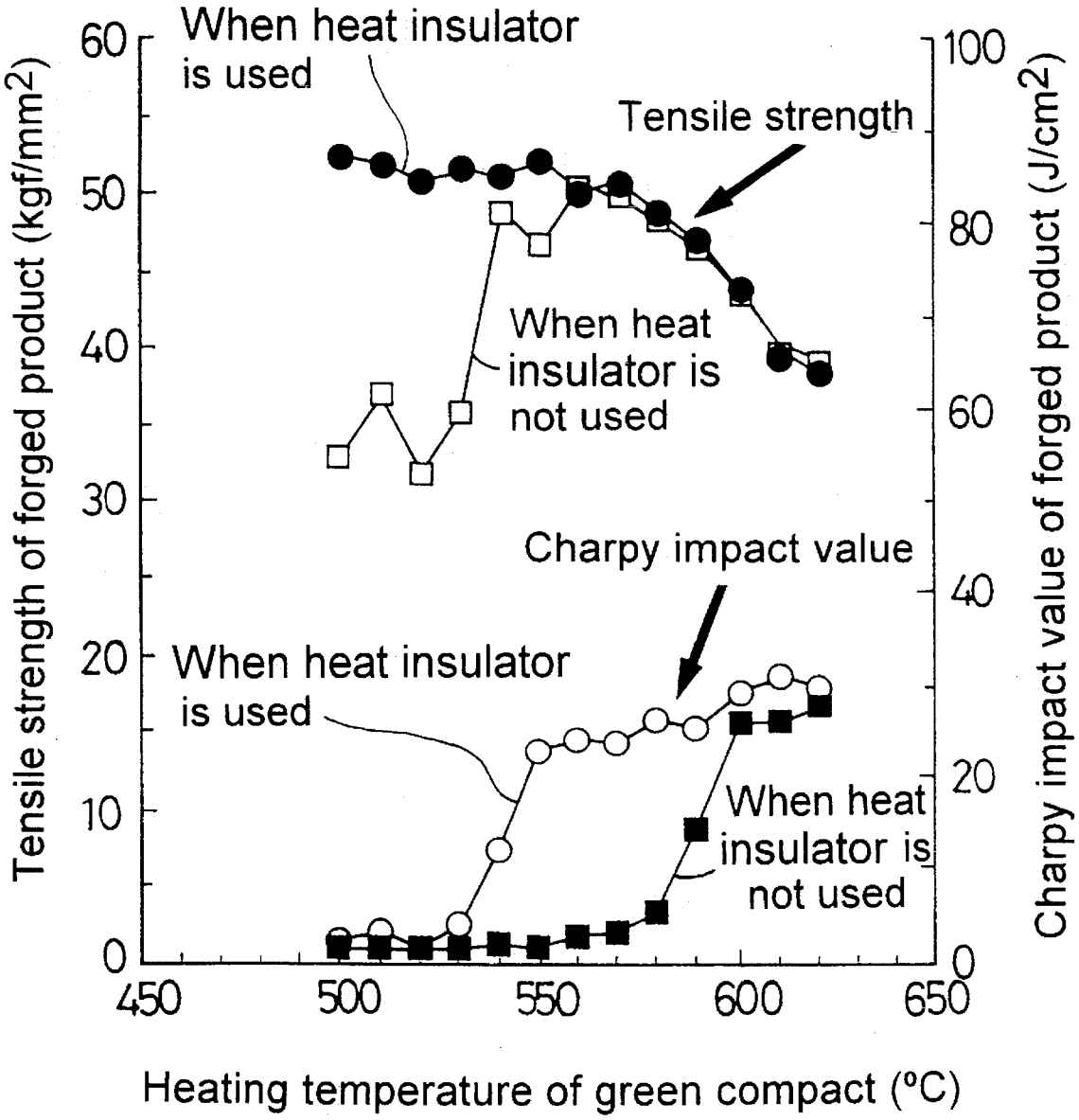
FIG. 7 is a graph illustrating the relationship between the heating temperature of the green compact and the tensile strength of a forged product as well as the Charpy impact value.

Test pieces were fabricated from the various forged products and subjected to a tensile test and a Charpy impact test to provide the results given in FIG. 7.

As apparent from FIG. 7, by using the heat insulator 12, the tensile strength of the forged product can be increased to 50 kg f/mm$^2$ or more, and the Charpy impact value can be increased to 20 J/cm$^2$ or more. Therefore, both high strength and high toughness can be achieved. The Charpy impact value equal to or more than 20 J/cm$^2$ was confirmed by the hot extrusion, and this means that the bonding of particles was achieved sufficiently.

If the heat insulator 12 was not used, the Charpy impact value was less than 20 J/cm$^2$, when the tensile strength of the forged product was on the order of 50 kg f/mm$^2$. On the other hand, the tensile strength was less than 50 kg f/mm$^2$, when the Charpy impact value was equal to or more than 20 J/cm$^2$.

For mass production, in order to increase the tensile strength of the forged product to 45 kg f/mm$^2$ or more and to increase the Charpy impact value to 20 J/cm$^2$ or more, when the heat insulator 12 was used, the heating temperature of the green compact 11 may be set in a range of 550° to 590° C. The control of the temperature is easy because the allowable temperature range is wide.

When the heat insulator 12 is not used, if the same mechanical properties are required for the forged product as those obtained using the heat insulator 12 as described above, it is necessary to set the heating temperature of the green compact to within an extremely small region and thus, such temperature control is impossible for mass production.

Example II

The above-described aluminum alloy powder ($Al_{93}Fe_{4.5}Ti_{0.5}Si_2$) in an amount of 20 grams was used to produce a prismatic green compact having a size of 13 mm (length)×10 mm (width)×70 mm (height) by a monoaxial compaction under a condition of a compacting pressure of 6 tons/cm$^2$. The relative density of the green compact was about 76%.

Two plate-like heat insulators having a thickness of 5 mm, a width of 10 mm and a length of 70 mm were fabricated using a carbon steel (JIS S45C).

The green compact was placed into a high-frequency coil and heated to 570° C. The two heat insulators were also heated to 610° C. using a muffle furnace. Further, the stationary and movable dies were heated to 200° C.

The green compact was sandwiched between the two heat insulators with the lateral side of the heated green compact mated to the widthwise side of each of the heated heat insulators. They were placed into the concave molding portion having a width of 11 mm and a length of 72 mm of the stationary die and were then subjected to a press-forging carried out by cooperation of the convex molding portion of the movable die with the concave molding portion of the stationary die with a forging pressure set at 8 tons/cm$^2$, thereby producing a forged product.

The forged product was subjected to a Charpy impact test without matching of opposite contact surfaces with the two heat insulators. As a result, it was ascertained that the Charpy impact value was 25 J/cm$^2$.

A reason why such a high Charpy impact value is provided is that the opposed surface of the green compact to the bottom surface of the concave molding portion and the opposed surface of the green compact to the end face of the convex molding portion are subjected to the temperature-maintaining effect of the two heat insulators, and the bonding of the powder particles occurs sufficiently in both of the opposed surfaces.

To sufficiently exhibit the temperature-maintaining effect, it is effective to set the heating temperature $T_2$ of the heat insulators at a value larger than the heating temperature $T_1$ of the green compact ($T_2>T_1$). The two heat insulators and the green compact are combined in a sandwich structure, leading to a further enhanced temperature-maintaining effect.

When both of the heat insulators are not used, even if the heating temperature of the green compact is increased to 610° C., the Charpy impact value of the forged product was as low as 12 J/cm$^2$ which was one half of that of the forged product produced using the heat insulators.

Example III

The above-described aluminum alloy powder ($Al_{93}Fe_{4.5}Ti_{0.5}Si_2$) in an amount of 500 grams was used to produce a green compact having a shape like a connecting rod for an internal combustion engine and having a thickness of 29 mm by a monoaxial compaction under a condition of a compacting pressure of 5 tons/cm$^2$. The relative density of the green compact was about 78%.

In addition, a stainless steel (JIS SUS304) was used to produce a plate-like heat insulator having a connecting rod-like shape and having a thickness of 8 mm.

The heated green compact was put on the heated heat insulator. They were placed into the concave molding portion of the stationary die and then subjected to a press-forging carried out by cooperation of the convex molding portion of the movable die and the concave molding portion of the stationary die with a forging pressure set at 8 tons/cm$^2$, thereby producing a connecting rod.

A test piece was fabricated from a rod portion of the connecting rod and subjected to a tensile test and a Charpy impact test. The result showed a tensile strength of 56 kg f/mm$^2$ and a Charpy impact value of 23.6 J/cm$^2$.

When a heat insulator was not used, a similar test piece fabricated in the same manner had a tensile strength of 53.3 kg f/mm$^2$ and a Charpy impact value of 2.9 J/cm$^2$.

What is claimed:

1. A powder forging process in which a heated green compact is placed into a stationary die and a press-forging is carried out for mainly reducing a thickness of the green compact, by cooperation of said stationary die with a movable die, wherein said press-forging comprises a plurality of pressing steps, each said pressing step being carried out with said green compact remaining in said stationary die, said pressing steps including a first pressing step and a second pressing step, a speed $V_1$ of movement of said movable die up to reaching a forging pressure at said first pressing step being higher than a speed $V_2$ of movement of the movable die up to reaching the same forging pressure at said second pressing step.

2. A powder forging process according to claim 1, wherein said green compact is formed of an aluminum alloy powder.

3. A powder forging process in which a heated green compact is placed into a stationary die and a forging is carried out by cooperation of said stationary die with a movable die, wherein said green compact is formed from aluminum alloy powder, and a heat insulator providing a temperature-retaining effect to the green compact and non-fusible to said green compact in the forging process is heated and then is positioned, together with said green compact, in said stationary die before the forging is carried out.

4. A powder forging process according to claim 3, wherein said heat insulator has a thermal conductivity $C_2$ smaller than a thermal conductivity $C_1$ of said green compact.

5. A powder forging process according to claim 3 or 4, wherein said heat insulator is formed from at least one alloy selected from the group consisting of Fe-based, Ni-based and Co-based alloys.

6. A powder forging process according to claim 3 or 4, wherein a heating temperature $T_2$ of said heat insulator is higher than a heating temperature $T_1$ of said green compact ($T_2>T_1$).

7. A powder forging process according to claim 5, wherein a heating temperature $T_2$ of said heat insulator is higher than a heating temperature $T_1$ of said green compact ($T_2>T_1$).

8. A powder forging process according to claim 3 or 4, wherein said green compact is sandwiched between two said heat insulators.

9. A powder forging process according to claim 5, wherein said green compact is sandwiched between two said heat insulators.

10. A powder forging process according to claim 6, wherein said green compact is sandwiched between two said heat insulators.

11. A powder forging process according to claim 7, wherein said green compact is sandwiched between two said heat insulators.

12. A powder forging process in which a heated green compact is placed into a stationary die and a press-forging is carried out by cooperation of said stationary die with a movable die, wherein said press-forging comprises a plurality of pressing steps with said green compact remaining in said stationary die during all said steps, said green compact being formed from aluminum alloy powder, and a heat insulator providing a temperature-retaining effect to the green compact and non-fusible to said green compact in the forging process is heated and then is placed, together with said green compact, into said stationary die before the forging is carried out.

13. A powder forging process according to claim 12, wherein said pressing steps include a first pressing step and a second pressing step, a speed $V_1$ of movement of said movable die up to reaching a forging pressure at said first pressing step being higher than a speed $V_2$ of movement of the movable die up to reaching the same forging pressure at said second pressing step.

14. A powder forging process according to claim 12, wherein said heat insulator has a thermal conductivity $C_2$ smaller than a thermal conductivity $C_1$ of said green compact.

15. A powder forging process according to claim 12, 13 or 14, wherein said heat insulator is formed from at least one alloy selected from the group consisting of Fe-based, Ni-based and Co-based alloys.

16. A powder forging process according to claim 12, 13 or 14, wherein a heating temperature $T_2$ of said heat insulator is higher than a heating temperature $T_1$ of said green compact.

17. A powder forging process according to claim 12, 13 or 14, wherein said green compact is sandwiched between the two said heat insulators.

18. A powder forging process comprising the steps of; heating a green compact of an aluminum alloy powder to a press-forging temperature and placing the heated green compact in a forging press, and subjecting the heat green compact to a plurality of successive pressing steps with the heated green compact remaining in the forging press during all of said pressing steps, wherein a speed of movement of a die up to reaching a forging pressure in a first said pressing step is faster than the speed of movement of said die up to reaching said forging pressure in a second said pressing step.

19. A powder forging process according to claim 18, wherein a heat insulator is heated and positioned in the forging press with the green compact before press-forging for providing a temperature-retaining effect to the green compact.

20. A powder forging process according to claim 19, wherein said heat insulator has a thermal conductivity smaller than a thermal conductivity of said green compact.

21. A powder forging process according to claim 19, wherein a heating temperature of said heat insulator is higher than a heating temperature of said green compact.

22. A powder forging process according to claim 20 wherein a heating temperature of said heat insulator is higher than a heating temperature of said green compact.

* * * * *